US009532124B2

(12) United States Patent
Satomi et al.

(10) Patent No.: US 9,532,124 B2
(45) **Date of Patent: *Dec. 27, 2016**

(54) INSTALLATION STRUCTURE FOR ACOUSTIC TRANSDUCER

(71) Applicant: Yamaha Corporation, Hamamatsu-Shi, Shizuoka-Ken (JP)

(72) Inventors: Masayuki Satomi, Hamamatsu (JP); Yuji Takahashi, Hamamatsu (JP); Kenta Ohnishi, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/565,931

(22) Filed: Dec. 10, 2014

(65) Prior Publication Data

US 2015/0163571 A1 Jun. 11, 2015

(30) Foreign Application Priority Data

Dec. 11, 2013 (JP) ..... 2013-255847

(51) Int. Cl.
*H04R 1/00* (2006.01)
*H04R 1/02* (2006.01)
(Continued)

(52) U.S. Cl.
CPC ..... *H04R 1/025* (2013.01); *G10H 1/32* (2013.01); *G10H 3/22* (2013.01); *H04R 7/04* (2013.01)

(58) Field of Classification Search
CPC ..... G10H 1/32
(Continued)

(56) References Cited

U.S. PATENT DOCUMENTS 5,703,553 A 12/1997 Bushko et al.
6,965,679 B1 11/2005 Lopez Bosio et al.
(Continued)

FOREIGN PATENT DOCUMENTS

DE 3831187 A1 3/1990
EP 1227700 A1 7/2002
(Continued)

OTHER PUBLICATIONS

Office Action of Korean application No. 10-2014-0177341 with English translation.
(Continued)

*Primary Examiner* — Matthew Eason
*Assistant Examiner* — Phan Le
(74) *Attorney, Agent, or Firm* — Blank Rome LLP

(57) ABSTRACT

An installation structure for an acoustic transducer that operates in accordance with an audio signal to vibrate a vibrated body in a first direction for permitting the vibrated body to generate sounds, including: a magnetic-path forming portion; a vibrating unit configured to vibrate in the first direction; a connecting member disposed between: a part of the vibrated body or a fixed portion fixed to the vibrated body; and the vibrating unit, for transmitting vibration of the vibrating unit to the vibrated body; a first joint portion that connects a first end portion of the connecting member to the vibrating unit for enabling the connecting member to be inclined with respect to an axis extending in the first direction; and a second joint portion that connects a second end portion of the connecting member to the fixed portion for enabling the connecting member to be inclined with respect to the axis.

10 Claims, 9 Drawing Sheets

(51) Int. Cl.

| | |
|---|---|
| ***G10H 1/32*** | (2006.01) |
| ***G10H 3/22*** | (2006.01) |
| *H04R 7/04* | (2006.01) |

(58) Field of Classification Search
USPC ..... 381/162, 150
See application file for complete search history.

(56) References Cited

U.S. PATENT DOCUMENTS

| | | | | |
|---|---|---|---|---|
| 7,085,391 | B1 | 8/2006 | Yamaya | |
| 2003/0015086 | A1* | 1/2003 | Katz | G10H 1/32 84/644 |
| 2006/0115107 | A1 | 6/2006 | Vincent et al. | |
| 2007/0025584 | A1* | 2/2007 | Iwata | H04R 1/025 381/394 |
| 2007/0142697 | A1 | 6/2007 | Schneider | |
| 2009/0211425 | A1* | 8/2009 | Jones | G10C 5/005 84/243 |
| 2013/0061733 | A1 | 3/2013 | Ohnishi et al. | |
| 2013/0092007 | A1 | 4/2013 | Ohnishi et al. | |
| 2013/0118333 | A1 | 5/2013 | Ohnishi et al. | |

FOREIGN PATENT DOCUMENTS

| | | | |
|---|---|---|---|
| EP | 2571016 | A2 | 3/2013 |
| EP | 2 793 221 | A1 | 10/2014 |
| JP | 59-50031 | A | 3/1984 |
| JP | H04-500735 | A | 2/1992 |
| JP | 2000-315088 | A | 11/2000 |
| JP | 2008-298992 | A | 12/2008 |
| JP | 2010-7835 | A | 1/2010 |
| JP | 2012-230406 | A | 11/2012 |
| JP | 2014-142408 | A | 8/2014 |
| KR | 10-1990-7002503 | A | 12/1990 |
| TW | 466468 | B | 12/2001 |
| WO | WO 83/03022 | A1 | 9/1983 |
| WO | WO-90/03025 | A1 | 3/1990 |
| WO | WO-2013/089239 | A1 | 6/2013 |
| WO | WO 2014/115482 | A1 | 7/2014 |

OTHER PUBLICATIONS

Office Action of Taiwan application No. 102147003 with English translation.
Non-Final Office Action mailed Nov. 10, 2015 in U.S. Appl. No. 14/762,611.
Supplemental European Search Report from EP Patent Application No. 13872580.9 dated Sep. 28, 2016.

* cited by examiner

INSTALLATION STRUCTURE FOR ACOUSTIC TRANSDUCER

CROSS REFERENCE TO RELATED APPLICATION

The present application claims priority from Japanese Patent Application No. 2013-255847, which was filed on Dec. 11, 2013, the disclosure of which is herein incorporated by reference in its entirety.

BACKGROUND OF THE INVENTION

Field of the Invention

The present invention relates to an installation structure for an acoustic transducer configured to operate in accordance with an audio signal for thereby vibrating a vibrated body so as to permit the vibrated body to generate sounds.

Description of Related Art

Conventional devices such as keyboard musical instruments are known in which an acoustic transducer operates in accordance with an audio signal to thereby vibrate a vibrated body, so that the vibrated body generates sounds. For instance, a keyboard musical instrument is provided with: the acoustic transducer fixed to a back post via a support member; and a movable unit connected to a soundboard that functions as the vibrated body to be vibrated. The movable wait (vibrating unit) is configured to vibrate when an electric current in accordance with the audio signal is supplied to a coil. The vibration of the vibrating unit is transmitted to the soundboard, so that the soundboard is vibrated to thereby generate sounds.

The following Patent Literature 1 describes an installation structure for the acoustic transducer provided in the keyboard musical instrument. In the disclosed structure, the vibrating unit in the form of a rod-like hammer is electromagnetically coupled to a magnetic-path forming portion having a magnet, a core, and so on. When an electric current is supplied to the coil, the vibrating unit reciprocates in its axial direction, so that the vibrating unit vibrates. The vibrating unit is fixedly bonded at its distal end portion to a flange fixed to the soundboard.

Patent Literature 1: Japanese Unexamined Patent Application Publication (Translation of PCT Application) No. 04-500735

SUMMARY OF THE INVENTION

The vibrated body such as the soundboard may suffer from a dimensional change or deformation due to changes over time by influences of the temperature and the humidity. In particular when the vibrated body is displaced in the horizontal direction perpendicular to a vibration direction in which the vibrating unit vibrates and the flange is accordingly displaced in the horizontal direction, the distal end portion of the vibrating unit is displaced in the horizontal direction together with the flange. When the amount of displacement becomes large to a certain extent, the vibrating unit and the magnetic-path forming portion may physically interfere with each other or electromagnetic coupling therebetween may fail, causing operation failure of the vibrating unit. In this instance, there may be a risk that the vibration is not appropriately transmitted and thus sounds are not appropriately generated. That is, the function of the acoustic transducer to vibrate the vibrated body cannot be maintained.

The present invention has been developed to solve the conventionally experienced problems. It is therefore an object of the invention to provide an installation structure for an acoustic transducer that ensures appropriate electromagnetic coupling between a magnetic-path forming portion and an electromagnetic coupling portion for maintaining an appropriate vibrating function of the acoustic transducer over a long period of time even if the vibrated body suffers from a dimensional change in a direction perpendicular to the vibration direction.

The above-indicated object may be attained according to a principle of the invention, which provides an installation structure for an acoustic transducer (50) configured to operate in accordance with an audio signal for thereby vibrating a vibrated body (7) in a first direction, so as to permit the vibrated body to generate sounds, comprising: a magnetic-path forming portion (52) fixedly disposed relative to a the fixedly supporting portion (55) and forming a magnetic path; a vibrating unit (200) having an electromagnetic coupling portion (EM) electromagnetically coupled to the magnetic-path forming portion, the vibrating unit being configured to vibrate in the first direction when the electromagnetic coupling portion is driven by the magnetic-path forming portion in response to a drive signal based on the audio signal; a connecting member (R; R1; R3) disposed between (a) a part of the vibrated body or a fixed portion (111; 1111; 311) fixed to the vibrated body and (b) the vibrating unit, the connecting member transmitting vibration of the vibrating unit to the vibrated body; a first joint portion (J1) configured to connect a first end portion (101*a*) of the connecting member to the vibrating unit so as to enable the connecting member to be inclined with respect to an axis extending in the first direction; and a second joint portion (J2) configured to connect a second end portion (101*b*) of the connecting member to the fixed portion so as to enable the connecting member to be inclined with respect to the axis extending in the first direction.

The reference numerals in the brackets attached to respective constituent elements in the above description correspond to reference numerals used in the following embodiment and modified examples to identify the respective constituent elements. The reference numerals attached to each constituent element indicates a correspondence between each element and its one example, and each element is not limited to the one example.

BRIEF DESCRIPTION OF DRAWINGS

The above and other objects, features, advantages and technical and industrial significance of the present invention will be better understood by reading the following detailed description of an embodiment of the invention, when considered in connection with the accompanying drawings, in which.

DETAILED DESCRIPTION OF THE EMBODIMENT

There will be explained one embodiment of the invention with reference to the drawings.

Figure 1:
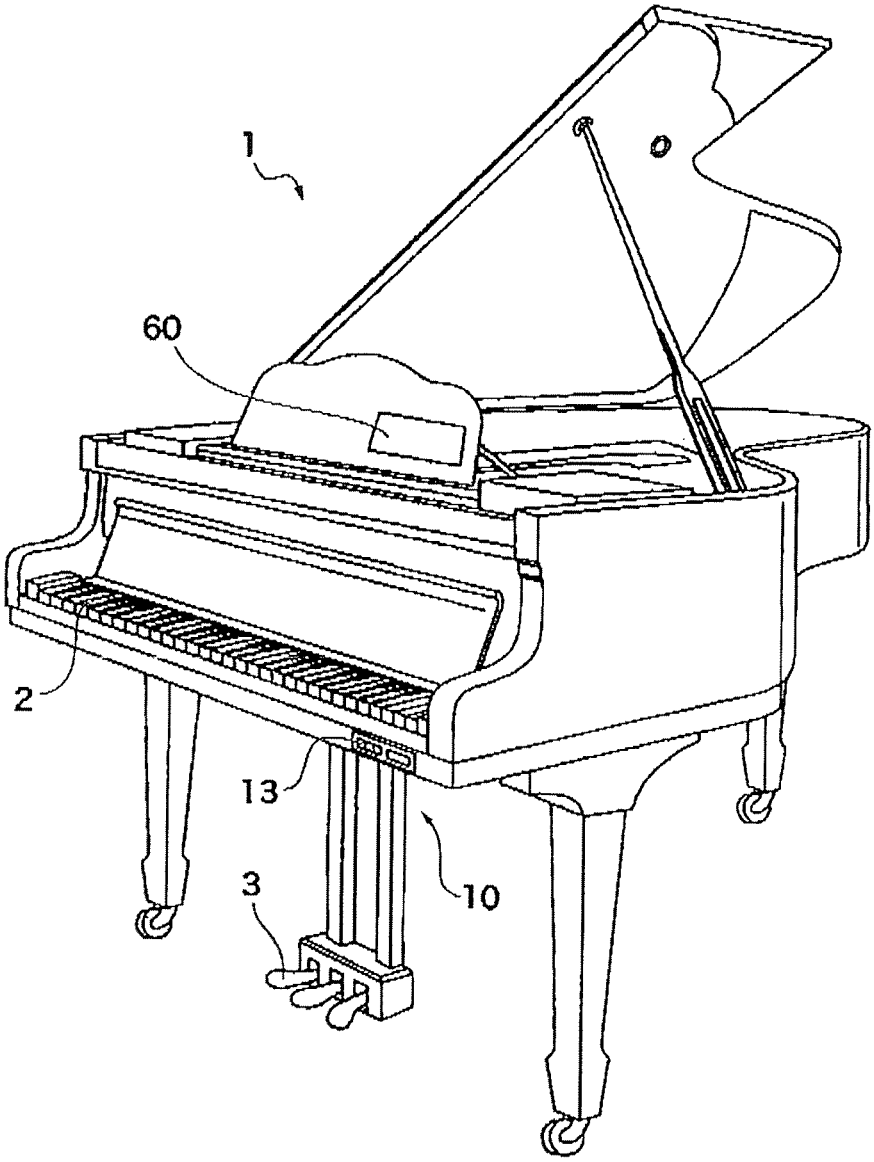
FIG. 1 is a perspective view showing an external appearance of a grand piano to which is applied an installation structure for an acoustic transducer according to one embodiment of the invention.

The perspective view of FIG. 1 shows a keyboard musical instrument in the form of a grand piano 1 as one example of devices and musical instruments to which is applied an installation structure for an acoustic transducer according to one embodiment of the invention. The acoustic transducer is configured to operate in accordance with an audio signal for thereby vibrating a vibrated body, so as to permit the vibrated body to generate sounds. A soundboard 7 is illustrated as one example of the vibrated body to be vibrated. It is noted the devices to which the present installation structure is applied is not limited to the grand piano 1 and the vibrated body is not limited to the soundboard 7. That is, the invention is applicable to any structure in which the acoustic transducer is driven in accordance with a drive signal based on the audio signal and the vibrated body is thereby vibrated for generating sounds.

The grand piano 1 has a keyboard and pedals 3 on its front side. The keyboard has a plurality of keys 2 that are operated by a performer (user) for performance. The grand piano 1 further has a controller 10 having an operation panel 13 on its front surface portion and a touch panel 60 provided on a music stand. User's instructions can be input to the controller 10 by a user's operation on the operation panel 13 and the touch panel 60.

Figure 2:
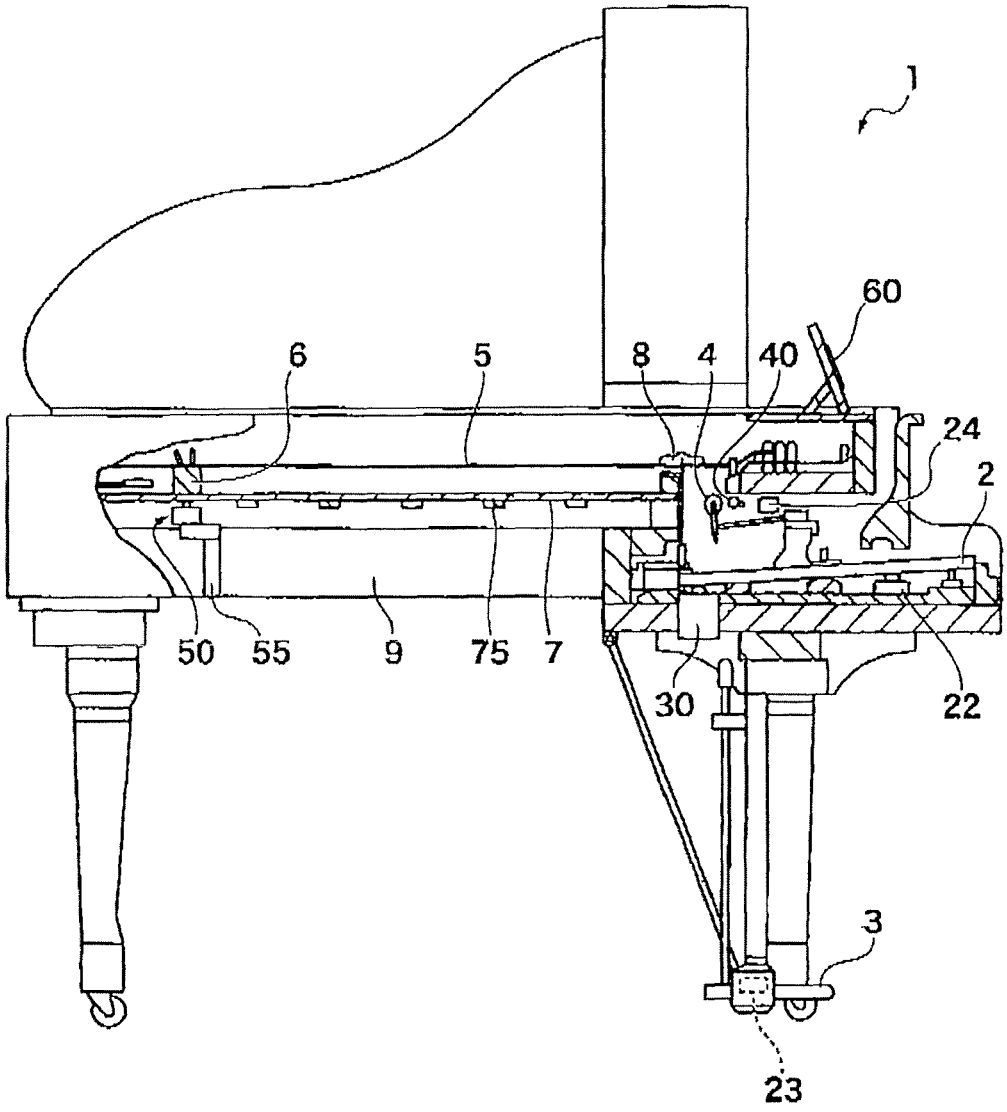
FIG. 2 is a cross-sectional view showing an internal structure of the grand piano.

In the cross-sectional view of FIG. 2 showing an internal structure of the grand piano 1, structures provided for each of the keys 2 are illustrated focusing on one key 2, and illustration of the structures for other keys 2 is omitted. A key drive unit 30 is provided below a rear end portion of each key 2 (i.e., on a rear side of each key 2 as viewed from the user who plays the piano 1 on the front side of the piano 1). The key drive unit 30 drives the corresponding key 2 using a solenoid.

The key drive unit 30 drives the solenoid in accordance with a control signal sent from the controller 10. That is, the key drive unit 30 drives the solenoid such that a plunger moves upward to reproduce a state similar to that when the user has depressed the key and such that the plunger moves downward to reproduce a state similar to that when the user has released the key.

Strings 5 and hammers 4 are provided so as to correspond to the respective keys 2. When one key 2 is depressed, the corresponding hammer 4 pivots via an action mechanism (not shown), so as to strike the string(s) 5 provided for the key 2. A damper 8 moves in accordance with a depression amount of the key 2 and a step-on amount of a damper pedal among the pedals 3, such that the damper 8 is placed in a non-contact state in which the damper 8 is not in contact with the string(s) 5 or in a contact state in which the damper 8 is in contact with the string(s) 5. A stopper 40 operates when a string-striking preventive mode is set in the controller 10. More specifically, the stopper 40 stops an upward movement of the corresponding hammer 4 to strike the string(s) 5, thereby preventing the string(s) 5 from being struck by the hammer 4.

Key sensors 22 are provided for the respective keys 2. Each key sensor 22 is disposed below the corresponding key 2 to output, to the controller 10, a detection signal in accordance with the behavior of the corresponding key 2. Hammer sensors 24 are provided for the respective hammers 4. Each hammer sensor 24 outputs, to the controller 10, a detection signal in accordance with the behavior of the corresponding hammer 4. Pedal sensors 23 are provided for the respective pedals 3. Each pedal sensor 23 outputs, to the controller 10, a detection signal in accordance with the behavior of the corresponding pedal 3.

While not shown, the controller 10 includes a CPU, a ROM, a RAM, a communication interface, and so on. The CPU executes control programs stored in the ROM for enabling the controller 10 to perform various controls.

The soundboard 7 is a wooden plate-shaped member, and soundboard ribs 75 and bridges 6 are attached to the soundboard 7. The strings 5 stretched under tension partially engage the bridges 6. In this structure, vibration of the soundboard 7 is transmitted to the strings 5 via the bridges 6 while vibration of the strings 5 is transmitted to the soundboard 7 via the bridges 6.

In the grand piano 1, acoustic transducers 50 are connected to the soundboard 7 such that each acoustic transducer 50 is supported by a corresponding support member 55 (as one example of a fixedly supporting portion) connected to a back post 9. Each support member 55 is formed of metal such as an aluminum material. The back posts 9 cooperate with a frame to support the tension of the strings 5 and constitute a part of the grand piano 1.

Figure 3:
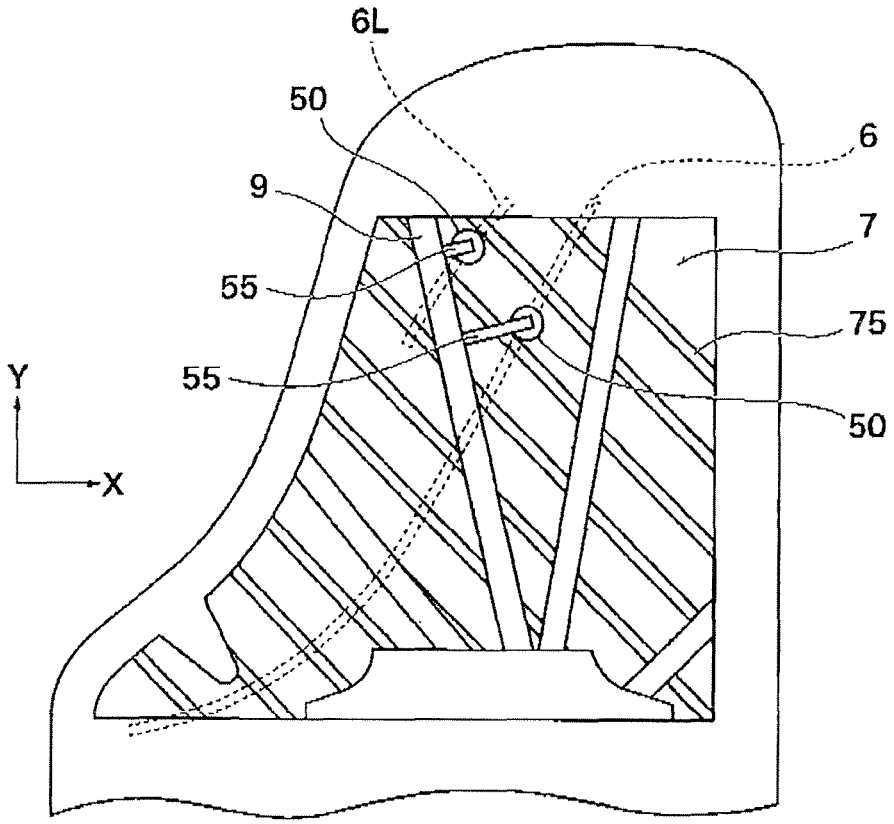
FIG. 3 is a view showing a back surface of a soundboard for explaining positions at which the acoustic transducers are installed.

FIG. 3 is a view showing a back surface of the soundboard 7 for explaining positions at which the acoustic transducers 50 are installed.

Each acoustic transducer 50 is connected to the soundboard 7 and is disposed between adjacent two of a plurality of soundboard ribs 75 attached to the soundboard 7. In FIG. 3, a plurality of, e.g., two acoustic transducers 50 having the same structure are connected to the soundboard 7. Only one acoustic transducer 50 may be connected to the soundboard 7. Each acoustic transducer 50 is disposed at a position as close as possible to the bridge 6. In the present embodiment, the acoustic transducer 50 is disposed at a position of the back surface of the soundboard 7 at which the acoustic transducer 50 is opposed to the bridge 6 with the soundboard 7 interposed therebetween. In the following explanation, a left-right direction, a front-rear direction, and an up-down (vertical) direction as viewed from a performer's side of the grand piano 1 are respectively referred to as "X-axis direction", "Y-axis direction" and "Z-axis direction". The Z-axis direction is one example of a first direction. The X-axis direction and the Y-axis direction (X-Y direction) correspond to the horizontal direction. The X-Y direction is one example of a second direction.

Figure 4B:
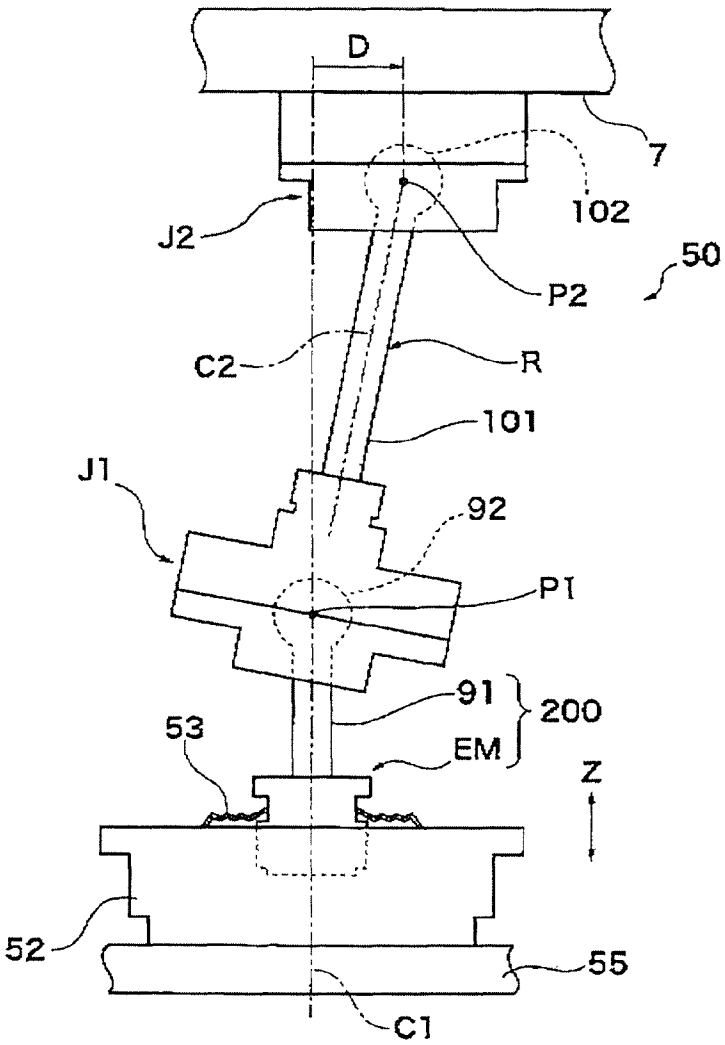
FIG. 4A is a side view of an acoustic transducer connected to a soundboard at the time of shipment and FIG. 4B is a side view of the acoustic transducer suffered from changes over time.
Figure 4A:
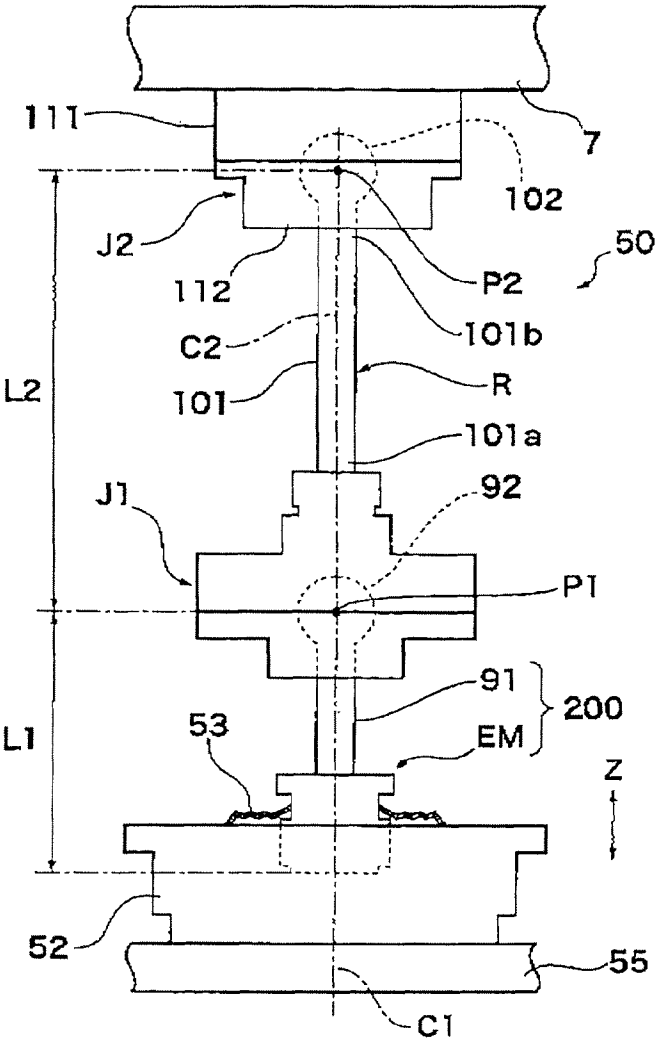

Each of FIGS. 4A and 4B shows a state in which the acoustic transducer 50 fixed to the support member 55 is connected to the soundboard 7. FIG. 4 shows a state of the acoustic transducer 50 at the time of shipment while FIG. 4B shows a state of the acoustic transducer 50 after having suffered from changes over time.

The acoustic transducer 50 is an actuator of a voice-coil type and is mainly constituted by a magnetic-path forming portion 52, a vibrating unit (movable unit) 200, and a connecting member R. The magnetic-path forming portion 52 is fixedly disposed relative to back post 9 via the support member 55. In other words, the magnetic-path forming portion 52 is in a fixed state relative to the back post 9. The vibrating unit 200 includes an electromagnetic coupling portion EM that is electromagnetically coupled to the magnetic-path forming portion 52 and a rod portion 91 that extends upward from the electromagnetic coupling portion EM. When a drive signal based on the audio signal is input to the magnetic-path forming portion 52, the electromagnetic coupling portion EM is driven by the magnetic-path forming portion 52, so as to vibrate in the Z-axis direction.

The connecting member R has a rod portion 101. At the time of shipment, the electromagnetic coupling portion EM is positioned relative to the horizontal direction (the X-Y direction) by a damper 53 (as one example of a movement restricting member) such that an axis C2 of the rod portion 101 of the connecting member R is coaxial with, namely, aligns with, an axis C1 of the magnetic-path forming portion 52. In other words, the damper 53 restricts a movement of the vibrating unit 200 in the horizontal direction relative to the magnetic-path forming portion 52. The axis C1 is parallel to an axis in the Z-axis direction that coincides with a vibration direction in which the vibrating unit 200 vibrates, namely, the axis C1 is parallel to the Z axis. The magnetic-path forming portion 52 will be later explained in detail.

The connecting member R is disposed between the soundboard 7 and the vibrating unit 200 for transmitting vibration of the vibrating unit 200 to the soundboard 7. A second joint portion J2 having a pointer member 111 and a chuck member 112 is fixed to the soundboard 7. The vibrating unit 200 and the connecting member R are connected to each other so as to be inclinable relative to each other owing to bending at a first joint portion J1, and the connecting member R and the soundboard 7 are connected to each other so as to be inclinable relative to each other owing to bending at the second joint portion J2.

While the structure of the first joint portion J1 and the second joint portion J2 will be explained in detail, each of the joint portions J1, J2 has a ball joint structure. A first end portion 101*a*, of the connecting member R that is a lower end portion of the rod portion 101 is connected to the first joint portion J1, and a spherical portion 92 provided at an upper end of the rod portion 91 is rotatable in the first joint portion J1. A spherical portion 102 provided at an upper end of a second end portion 101*b* of the rod portion 101 of the connecting member R is rotatable in the second joint portion J2.

The connecting member R is rotatable about any axis perpendicular to the Z axis while a first pivot point P1 of the first joint portion J1 serves as a pivot center. Thus, the connecting member R is inclinable relative to the axis C1 of the vibrating unit 200 that coincides with the Z axis, owing to bending at the first joint portion J1. The connecting member R is also rotatable about any axis perpendicular to the Z axis while a second pivot point P2 of the second joint portion J2 serves as a pivot center. Consequently, the connecting member R is inclinable relative to the Z axis owing to bending at the second joint portion J2. The motion that causes bending at the first joint portion J1 and the second joint portion J2 is substantially a pivotal motion.

The best way to ensure appropriate electromagnetic coupling between the magnetic-path forming portion 52 and the electromagnetic coupling portion EM is to align the axis C2 of the connecting member R and the axis C1 of the magnetic-path forming portion 52 with each other. In other words, the axis C2 and the axis C1 are in coaxial alignment with each other for appropriate electromagnetic coupling. However, when the soundboard 7 suffers from a dimensional change or deformation due to changes over time, a portion to which the connecting member R is connected, in other words, the pointer member 111 fixed to the soundboard 7, may also be displaced in the horizontal direction. If the pointer member 111 is displaced in the horizontal direction to such an extent that a relative position of the electromagnetic coupling portion EM in the horizontal direction cannot be retained by the damper 53, the positional relationship between the electromagnetic coupling portion EM and the magnetic-path forming portion 52 would become inappropriate, causing a risk that the vibrating unit 200 fails to vibrate appropriately.

In view of this, it is required to provide a displacement absorbing mechanism for preventing the position, in the horizontal direction, of the electromagnetic coupling portion EM relative to the magnetic-path forming portion 52 from being changed even if the soundboard 7 suffers from a horizontal displacement over time. It is impossible to unlimitedly deal with the horizontal displacement of the soundboard 7. However, because the amount of displacement of the soundboard 7 over time can be estimated, it is only required to absorb the displacement in the estimated (predetermined) range.

It is rather difficult to realize the problem described above at an initial stage of usage of the product. In addition, it is necessary to conceive a mechanism that enables the vibration transmission function in the Z-axis direction to be maintained while absorbing the dimensional change in the horizontal direction. To attain such a mechanism, a novel or unique idea is needed. According to the present embodiment, at least two joint portions J1, J2 are disposed between the soundboard 7 and the vibrating unit 200.

More specifically, when the portion of the soundboard 7 to which the connecting member R is connected is displaced in the horizontal direction within a predetermined range, e.g., within a displacement amount D shown in FIG. 4B, the second joint portion J2 is displaced relative to the back post 9 (or relative to the magnetic-path forming portion 52) in the horizontal direction owing to bending at the joint portions J1, J2, whereby the connecting member R is inclined. In this instance, the vibrating unit 200 is neither displaced in the horizontal direction nor inclined. Consequently, the vibrating unit 200 is not displaced in the horizontal direction and is not inclined over a long period of time, so that the position, in the horizontal direction, of the spherical portion 92 relative to the magnetic-path forming portion 52 is not changed. Thus, the electromagnetic coupling between the magnetic-path forming portion 52 and the electromagnetic coupling portion EM can be appropriately maintained, and the acoustic transducer 50 maintains a good function of transmitting the vibration of the vibrating unit 200 to the soundboard 7.

As shown in FIG. 4A, a distance in the Z-axis direction between: the position of the lower end of the electromagnetic coupling portion EM, in other words, one end of the vibrating unit 200 near to the back post 9; and the position of the first joint portion J1 (that is defined by the position of the first pivot point P1) is defined as L1 while a distance between the position of the first joint portion J1 and the position of the second joint portion J2 (that is defined by the position of the second pivot point P2) is defined as L2. The distance L1 is smaller than the distance L2.

Owing to the distance L1 smaller than the distance L2, the flexural rigidity of the rod portion 91 can be enhanced without a need of increasing its thickness, and the vibrating unit 200 is less likely to incline relative to the Z axis. Consequently, the position of the spherical portion 92 or the first joint portion J1 is prevented from being temporarily displaced in the horizontal direction by the drive force when the vibration is transmitted. This also makes it possible that appropriate electromagnetic coupling between the magnetic-path forming portion 52 and the electromagnetic coupling portion is maintained.

The first and second joint portions J1, J2 will be explained below.

Figure 5A:
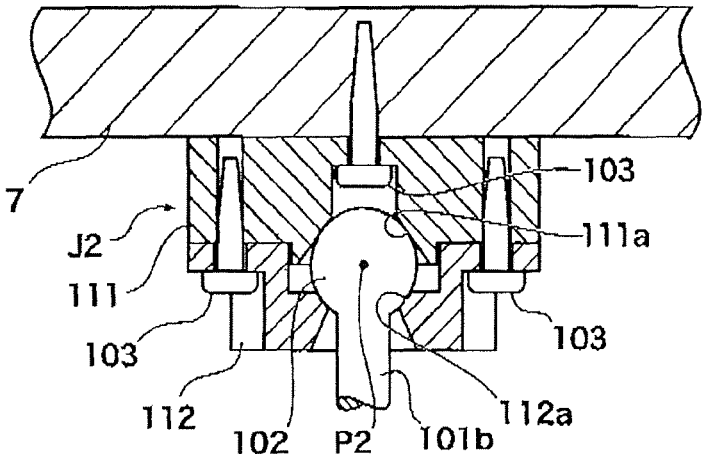
FIGS. 5A and 5B are vertical cross-sectional views respectively showing one example of a second joint portion and one example of a first joint portion.

As shown in the vertical cross-sectional view of FIG. 5A, the second joint portion J2 has a ball joint structure including the pointer member 111 and the chuck member 112. The pointer member 111 is fixed to the soundboard 7 by a screw 103, and the chuck member 112 is fixed at its flange to the pointer member 111 by screws 103.

The spherical portion 102 of the connecting member R is disposed between a tapered surface 111*a* of the pointer member 111 and a tapered surface 112*a* of the chuck member 112. The chuck member 112 is fixedly fastened to the pointer member 111, whereby the position of the spherical portion 102 in the Z-axis direction is determined or defined by the tapered surface 111*a* and the tapered surface 112*a*.

When the pointer member 111 is displaced, by a displacement of the soundboard 7, in a direction that includes a component in the horizontal direction, namely, in a direction different from or intersecting the vibration direction, the spherical portion 102 can accordingly rotate about an axis perpendicular to the Z axis, e.g., about the X axis or the Y axis, in the tapered surfaces 111*a*, 112*a*. Consequently, the connecting member R is permitted to be inclined about the pivot point P2 relative to the Z axis without an excessively large force applied to the connecting member R.

Figure 5B:
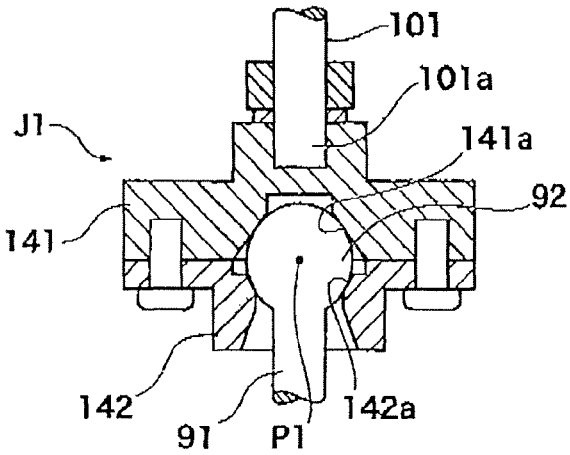

Like the second joint portion J2, the first joint portion J1 has a ball joint structure including a pointer member 141 and a chuck member 142, as shown in FIG. 5B. The pointer member 141 is fixed to the first end portion 101*a* of the connecting member R, and the chuck member 142 is fixed at its flange to the pointer member 141 by screws.

The spherical portion 92 is disposed between a tapered surface 141*a* of the pointer member 141 and a tapered surface 142*a* of the chuck member 142. The chuck member 142 is fixedly fastened to the pointer member 141, whereby the position of the spherical portion 92 in the Z-axis direction is determined or defined by the tapered surface 141*a* and the tapered surface 142*a*.

When the connecting member R is inclined by a displacement of the soundboard 7, the tapered surfaces 141*a*, 142*a* can accordingly rotate, relative to the spherical portion 92, about the axis perpendicular to the Z axis (e.g., the X axis or the Y axis). Consequently, the connecting member R is permitted to be inclined about the first pivot point P1 relative to Z axis without an excessively large force applied to the connecting member R.

The rod portion 101, 91 is formed of metal, for instance. The rod portion 101, 91 is required to exhibit vibration transmitting property. Where the rod portion 101, 91 is formed of metal, the rod portion 101, 91 has a high degree of rigidity in the vibration direction and exhibits excellent vibration transmitting property. Thus, it is preferable to employ metal as the material for the rod portion 101, 91. The pointer member 111, 141 and the chuck member 112, 142 are formed of resin, for instance, for ensuring a high degree of dimensional accuracy. The pointer member 111, 141 and the chuck member 112, 142 may be formed of metal with vibration transmitting property and a dimensional change taken into consideration. The pointer member 111, 141 and the chuck member 112, 142 may be formed such that a part thereof is formed of resin and another part thereof is formed of metal.

Figure 5C:
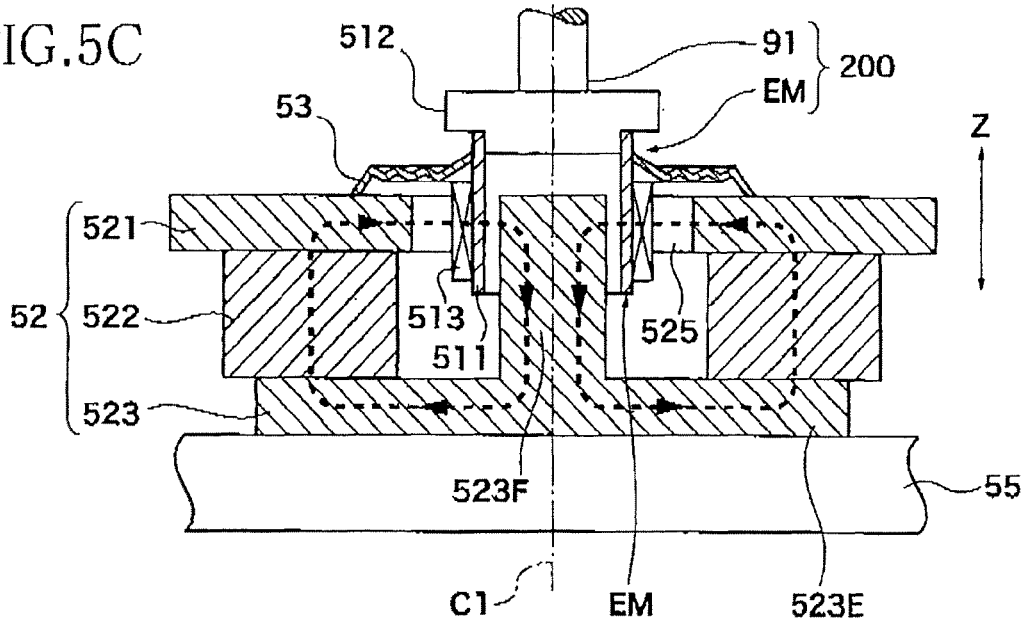
FIG. 5C is a vertical cross-sectional view showing a magnetic-path forming portion and an electromagnetic coupling portion.

FIG. 5C is a vertical cross sectional view showing the magnetic-path forming portion 52 and the electromagnetic coupling portion EM. The electromagnetic coupling portion EM of the vibrating unit 200 includes a cap 512, a bobbin 511, and a voice coil 513. The cap 512 is fixed to the lower end portion of the rod portion 91, and the bobbin 511 having an annular shape is fixedly fitted on a lower portion of the cap 512. The voice coil 513 is constituted by conductor wires wound around the outer circumferential surface of the bobbin 511. The voice coil 513 converts, into vibration, changes in an electric current flowing in a magnetic field formed by the magnetic-path forming portion 52.

The magnetic-path forming portion 52 includes a top plate 521, a magnet 522, and a yoke 523 that are arranged in this order from the upper side. The electromagnetic coupling portion EM is supported by a damper 53 such that the electromagnetic coupling portion EM can be displaced in the Z-axis direction without contacting the magnetic-path forming portion 52. The damper 53 is formed of fiber or the like and has a disc-like shape. The damper 53 has a waved shape like bellows at its disc-like portion. The damper 53 is attached at its outer peripheral end to the upper surface of the top plate 521 and at its inner peripheral end to the bobbin 511 of the electromagnetic coupling portion EM.

The magnetic-path forming portion 52 is fixedly disposed relative to the back post 9 such that the yoke 523 is fixed to the support member 55 by screws or the like, for instance. That is, the magnetic-path forming portion 52 is in a fixed state relative to the back post. Consequently, the support member 55 has a function of permitting the magnetic-path forming portion 52 to be fixed to the back post 9 as a stationary portion.

The top plate 521 is formed of a soft magnetic material such as soft iron and has a disc-like shape having a central hole. The yoke 523 is formed of a soft magnetic material such as soft iron. The yoke 523 is constituted by a disc portion 523E and a cylindrical portion 523F having an outer diameter smaller than that of the disc portion 523E. The disc portion 523E and the cylindrical portion 523F are formed integrally with each other such that the axes of the disc portion 523E and the cylindrical portion 523F are aligned with each other. The outer diameter of the cylindrical portion 523F is smaller than an inner diameter of the top plate 521. The magnet 522 is a doughnut-shaped permanent magnet and has an inner diameter larger than the inner diameter of the top plate 521. The cylindrical portion 523F is loosely fitted in a hollow portion of the bobbin 511.

The axes of the top plate 521, the magnet 522, and the yoke 523 are aligned with one another and coincide with the axis C1 of the magnetic-path forming portion 52. This arrangement forms a magnetic path shown by arrows in the broken line in FIG. 5C. The electromagnetic coupling portion EM is disposed such that the voice coil 513 is located in a space between the top plate 521 and the cylindrical portion 523F, i.e., in a magnetic-path space 525. In this instance, the electromagnetic coupling portion EM is positioned relative to the horizontal direction, i.e., the X-Y direction, by the damper 53, such that the axis C2 of the connecting member R is coaxial with the axis C1 of the magnetic-path forming portion 52. Thus, the rod portion 91 extends in parallel with the Z-axis direction.

A drive signal based on an audio signal is input from the controller 10 to the acoustic transducer 50. For instance, audio data stored in a storage portion (not shown) is read out by the controller 10, and the drive signal is generated on the basis of the read data. Alternatively, when the soundboard 7 is vibrated in accordance with a performance operation, the behaviors of the keys 2, the pedals 3, and the hammers 4 are detected respectively by the key sensors 22, the pedal sensors 23, and the hammer sensors 24, whereby the performance operation of the player is detected. On the basis of the detection results, the controller 10 generates performance information. The controller 10 subsequently generates an acoustic signal on the basis of the performance information. The acoustic signal is processed and amplified so as to be output to the acoustic transducer 50 as the drive signal.

When the drive signal is input to the voice coil 513, the voice coil 513 receives a magnetic force in the magnetic-path space 525, and the bobbin 511 receives a drive force in the Z-axis direction in accordance with the waveform indicated by the drive signal input to the voice coil 513, Consequently, the electromagnetic coupling portion EM is driven by the magnetic-path forming portion 52, so that the vibrating unit 200 including the electromagnetic coupling portion EM vibrates in the Z-axis direction. When the vibrating unit 200 vibrates in the Z-axis direction, the vibration of the vibrating unit 200 is transmitted to the soundboard 7 by the connecting member R, so that the soundboard 7 is vibrated and sound generated by the vibration of the soundboard 7 are emitted in the air.

The damper 53 has a function of supporting the magnetic-path forming portion 52 such that the vibrating unit 200 can be displaced in the vibration direction that coincides with the Z-axis direction while the vibrating unit 200 is kept in coaxial alignment with the axis C1. The joint portions J1, J2 can follow a relatively slow horizontal displacement of the soundboard 7 caused by changes over time and have hardness that enables the joint portions J1, J2 to be bent to such an extent that a force can be transmitted, with respect to a motion in the vibration direction having a short cycle. A force by which the damper 53 permits the vibrating unit 200 to be kept coaxial with the axis C1 in the horizontal direction is made sufficiently larger than a force by which the joint portions J1, J2 resist bending with respect to the horizontal direction. In other words, a force applied from the pointer member 111 to the joint portions J1, J2 when at least one of the first and second joint portions J1, J2 starts to bend by a displacement, in the horizontal direction, of the pointer member 111 relative to the magnetic-path forming portion 52 is made sufficiently smaller than a force applied from the pointer member 111 to the vibrating unit 200 when the vibrating unit 200 starts to move by the displacement against a force by which damper 53 permits the axis C2 to be kept aligned or coaxial with the axis C1. When the soundboard 7 is displaced in the horizontal direction due to changes over time, the connecting member R is inclined owing to bending at the joint portions J1, J2. However, the damper 53 keeps holding the vibrating unit 200 such that the vibrating unit 200 is kept located at the same position in the horizontal direction.

The damper 53 may be formed such that its disc-like portion has a bellows-like shape in the entire circumferential direction. The damper 53 may be formed of resin having elasticity as long as the damper 53 permits the axis of the vibrating unit 200 and the bobbin 511 to be retained at a central portion thereof. Moreover, the damper 53 may be configured to hold the axis of the vibrating unit 200 and the bobbin 511 at several locations in the circumferential direction, instead of holding the same over the entire circumferential direction.

According to the present embodiment, when the portion of the soundboard 7 to which the connecting member R is connected is displaced in the horizontal direction within a predetermined range, the second joint portion J2 is displaced in the horizontal direction owing to bending at the joint portions J1, J2 to cause inclination of the connecting member R while the vibrating unit 200 is prevented from being inclined and displaced in the horizontal direction. Thus, the vibrating unit 200 is kept located at the same position in the horizontal direction. As a result, even when the soundboard 7 suffers from a dimensional change in the direction perpendicular to the vibration direction due to changes over time, the electromagnetic coupling between the magnetic-path forming portion 52 and the electromagnetic coupling portion EM can be maintained and the acoustic transducer 50 can maintain an appropriate vibrating function over a long period of time.

The structure of the joint portions J1, J2 is not limited to those illustrated above. There may be employed any other structure that enables axes of members connected by the joint portions J1, J2 to be inclined relative to each other by bending. Various modified examples of the joint portions J1, J2 will be explained below with respect to FIGS. 6-9.

Figure 6A:
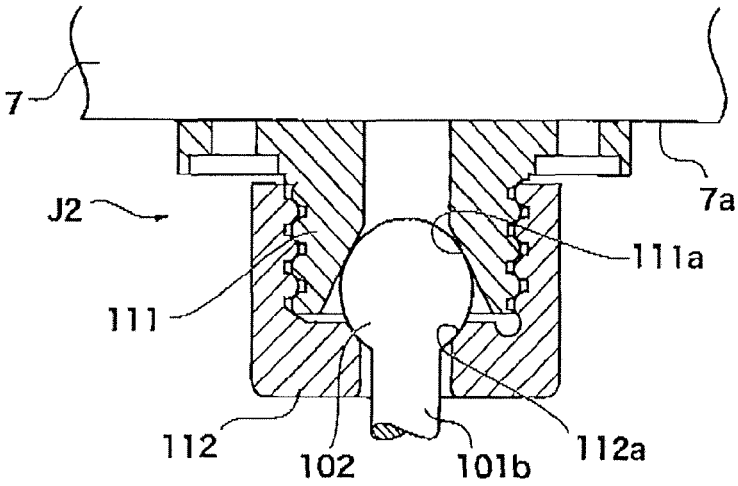
FIG. 6A is a vertical cross-sectional view showing one modified example of the second joint portion.
Figure 6B:
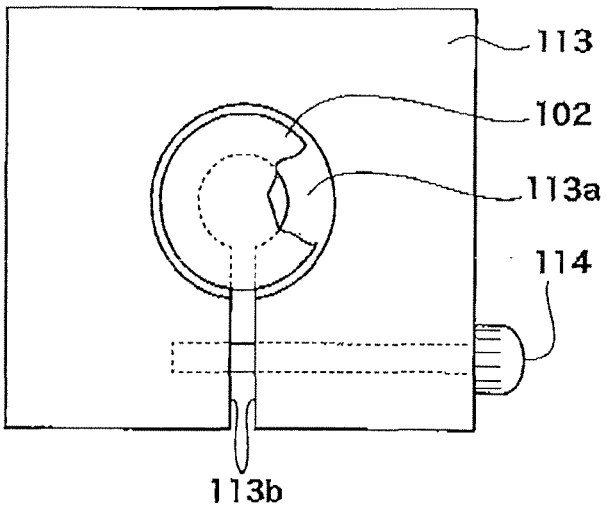
FIGS. 6B and 6C are a plan view and a vertical cross-sectional view showing another modified example of the second joint portion.
Figure 6C:
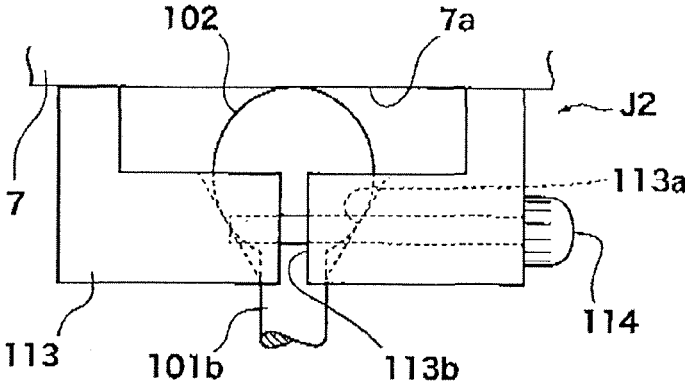

FIG. 6A is a vertical cross-sectional view showing one modified example of the second joint portion J2. FIGS. 6B and 6C are a plan view and a vertical cross-sectional view showing another modified example of the second joint portion J2.

In the second joint portion J2 shown in FIG. 6A, the pointer member 111 is fixed to a lower surface 7*a* of the soundboard 7 by screwing or the like, and the chuck member 112 is threadedly engaged with the pointer member 111. The spherical portion 102 of the rod portion 101 is disposed between the tapered surface 111*a* of the pointer member 111 and the tapered surface 112*a* of the chuck member 112. The chuck member 112 is fastened to the pointer member 111 by being screwed onto the pointer member 111, whereby the tapered surface 111*a* and the tapered surface 112*a* cooperate with each other to define the position of the spherical portion 102 in the Z-axis direction.

The second joint portion J2 shown in FIGS. 6B and 6C has a retainer 113 fixed to the soundboard 7. The retainer 113 has two extensions split by a slit 113*b* formed therebetween. The spherical portion 102 is disposed on a tapered surface 113*a* formed in the retainer 113, and the two extensions are fastened by a screw 114 so as to reduce the size of the slit 113*b*. Thus, the position of the spherical portion 102 in the Z-axis direction is defined by the lower surface 7*a* of the soundboard 7 and the tapered surface 113*a*. In this structure, the lower surface 7*a* of the soundboard 7 directly contacts the connecting member R. This structure is suitable in a case in which the surface of the vibrated body that contacts the connecting member R is perpendicular to the Z axis.

Figure 7B:
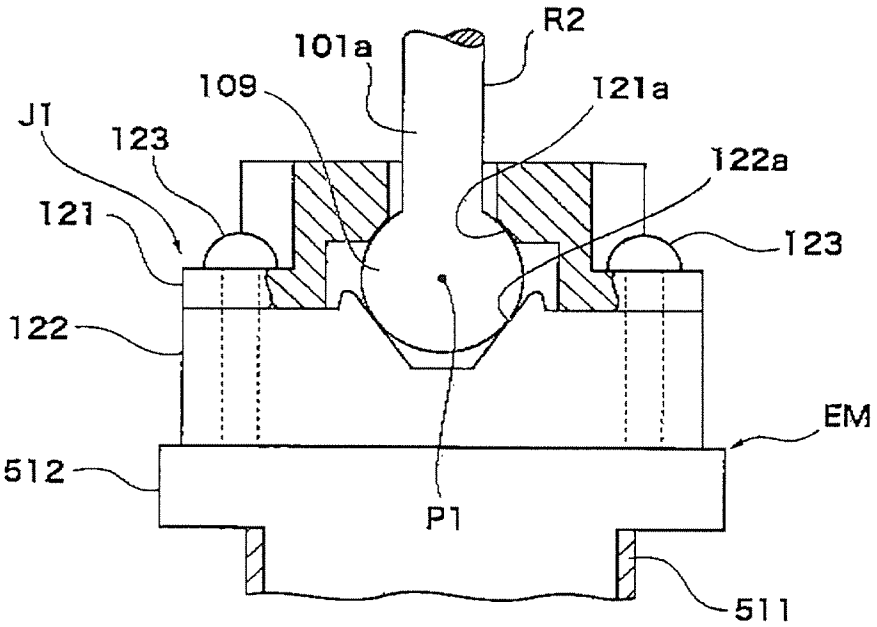
FIG. 7B is a vertical cross-sectional view showing another modified example of the first joint portion.
Figure 7A:
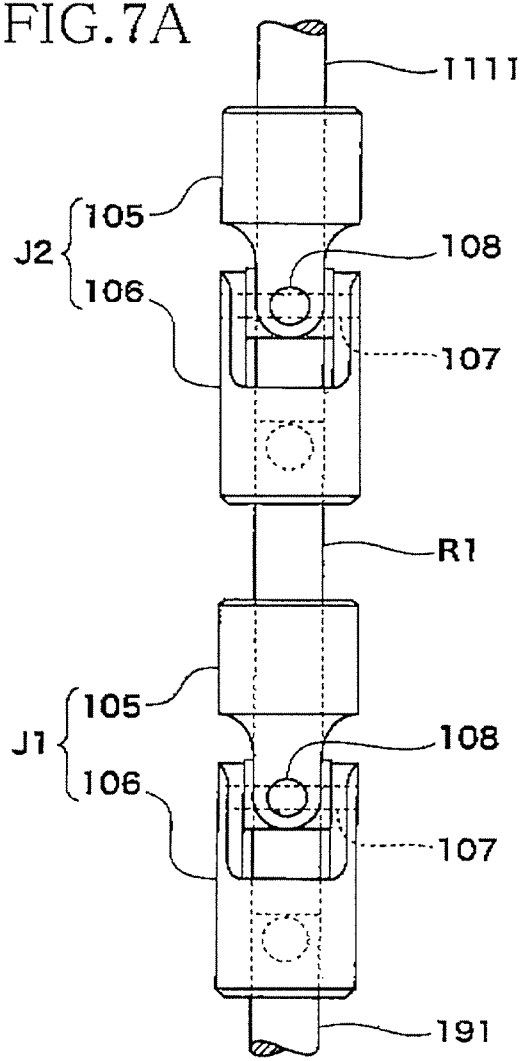
FIG. 7A is a partial side view showing one modified example of the acoustic transducer in which a universal joint structure is used in each of the joint portions.

FIG. 7A is a partial side showing one modified example of the acoustic transducer in which a universal joint structure is used for each of the joint portions J1, J2.

It is required that the connecting member R be interposed between: a part of the soundboard 7 (as one example of the vibrated body) or a portion (as one example of a fixed portion) to which the connecting member R is fixed with respect to the soundboard 7; and the vibrating unit 200. The pointer member 111 in FIGS. 4A-4B and FIG. 6A corresponds to the fixed portion. The fixed portion may be formed as a member having a given length such as a soundboard-side rod portion 1111 shown in FIG. 7A that is fixed to the soundboard 7 so as to downwardly extend therefrom.

In the modified example of FIG. 7A, the vibrating unit 200 has a vibrating-unit-side rod portion 191 that corresponds to the rod portion 91. The connecting member R1 that corresponds to the connecting member R is connected to the soundboard-side rod portion 1111 so as to be bendable at the second joint portion J2 and is connected to the vibrating-unit-side rod portion 191 so as to be bendable at the first joint portion J1. Each of the joint portions J1, J2 is constituted by a universal joint having engagement members 105, 106. The engagement member 105 and the engagement member 106 are rotatably supported by a shaft 107 so as to be pivotable about the X axis and by a shaft 108 so as to be pivotable about the Y axis.

FIG. 7B is a vertical cross-sectional view showing one modified example of the first joint portion J1. In the example of FIG. 4 illustrated above, the vibrating unit 200 has the rod portion 91 extending from the electromagnetic coupling portion EM, and the rod portion 91 has the spherical portion 92. Instead, a connecting member R2 corresponding to the connecting member R may have the spherical portion, as shown in FIG. 7B.

The first joint portion J1 in the modified example of FIG. 7B has a structure similar to that of the second joint portion J2 shown in FIG. 5A. The first joint portion J1 is disposed near the first end portion 101*a*. A spherical portion 109 is provided at the first end portion 101*a* of the connecting member R2. A lower member 122 is fixed to the cap 512 by bonding or by screws (not shown) while an upper member 121 is fixed to the lower member 122 by screws 123. The position of the spherical portion 109 in the Z-axis direction is defined by a tapered surface 121*a* of the upper member 121 and a tapered surface 122*a* of the lower member 122.

Figure 8:
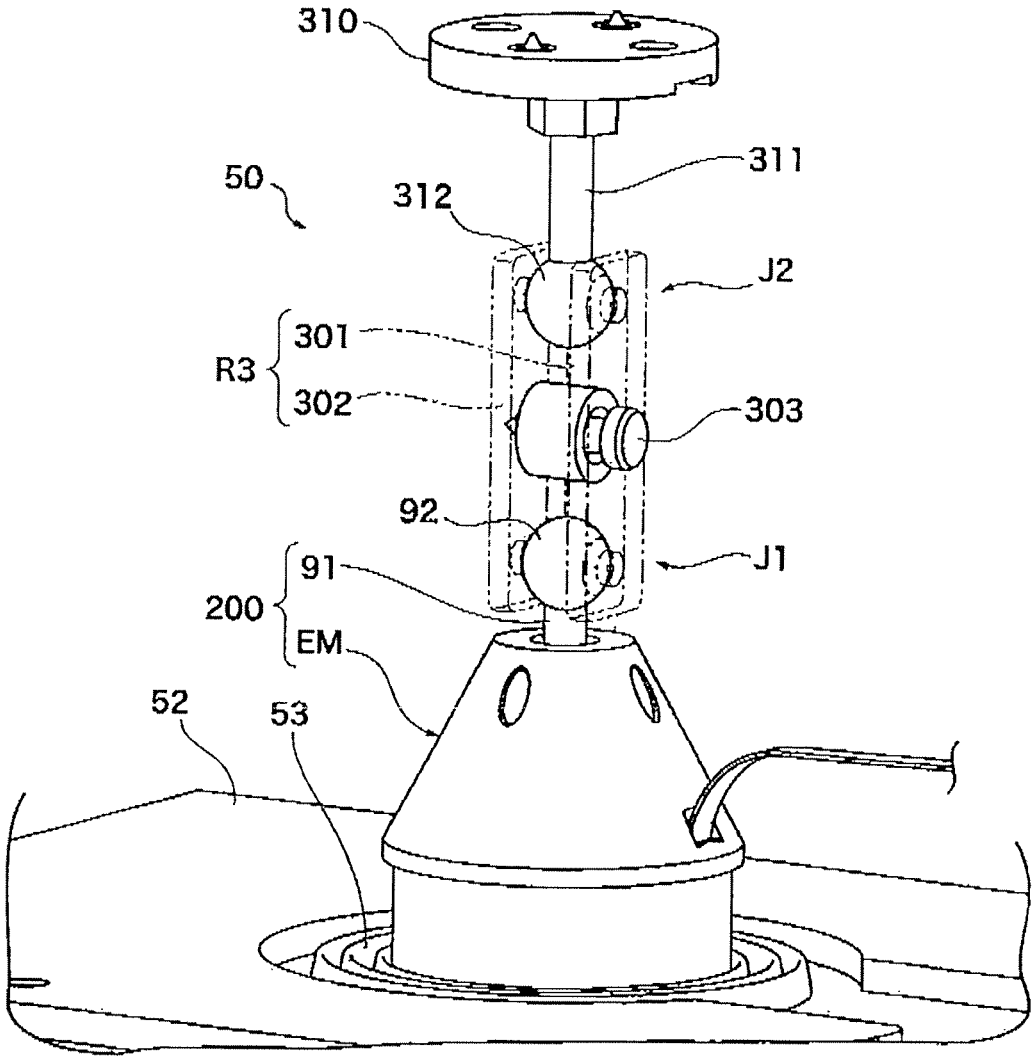
FIG. 8 is a perspective view of the acoustic transducer in which joint portions and a connecting member according to still another modified example are employed.
Figure 9:
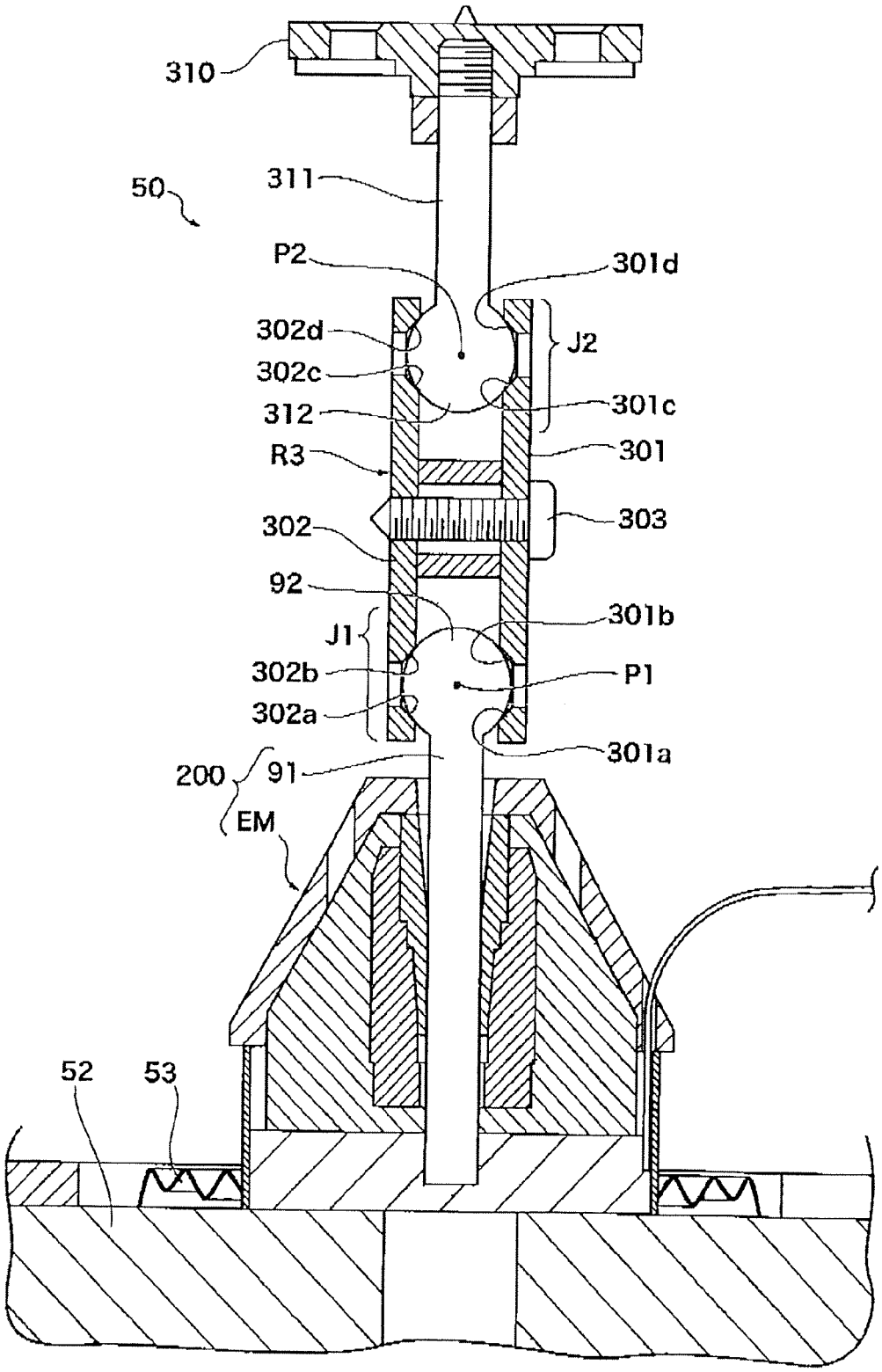
FIG. 9 is a vertical cross-sectional view of the acoustic transducer shown in FIG. 8.

FIG. 8 is a perspective view and FIG. 9 is a vertical cross-sectional view, each showing the acoustic transducer 50 in which joint portions J1, J2 and a connecting member according to one modified example are employed.

The acoustic transducer 50 according to the modified example has a connecting member R3 corresponding to the connecting member R. The vibrating unit 200 and the magnetic-path forming portion 52 differ in shape from those of FIG. 4, etc., but are identical in construction. The vibrating unit 200 and the magnetic-path forming portion 52 in this modified example may be identical in shape with those of FIG. 4, etc.

The acoustic transducer 50 shown in FIGS. 8 and 9 has a secured portion 310 that is secured to the soundboard 7. A soundboard-side rod portion 311 is fixed to the secured portion 310 so as to extend downwardly therefrom. A spherical portion 312 is provided at a lower end of the soundboard-side rod portion 311. The soundboard-side rod portion 311 functions as the fixed portion that is fixed relative to the soundboard 7.

The connecting member R3 is constituted by plate portions 301, 302 formed of metal. The plate portions 301, 302 are disposed in parallel with each other and are fixed to each other by a bolt 303, such that the spherical portion 312 and the spherical portion 92 are sandwiched therebetween respectively on upper and lower portions of the plate portions 301, 302. As shown in FIG. 9, tapered surfaces 301*a*, 301*b* are formed at the lower portion of the plate portion 301 at which the spherical portion 92 is held while tapered surfaces 302*a*, 302*b* are formed at the lower portion of the plate portion 302 at which the spherical portion 92 is held. Further, tapered surfaces 301*c*, 301*d* are formed at the upper portion of the plate portion 301 at which the spherical portion 312 is held while tapered surfaces 302*c*, 302*d* are formed at the upper portion of the plate portion 302 at which the spherical portion 312 is held.

The position of the spherical portion 92 in the Z-axis direction is defined by the tapered surfaces 301*a*, 301*b* and the tapered surfaces 302*a*, 302*b* at the first joint portion J1. The position of the spherical portion 312 in the Z-axis direction is defined by the tapered surfaces 301*c*, 301*d* and the tapered surfaces 302*c*, 302*d* at the second joint portion J2.

When the soundboard-side rod portion 311 is displaced in a direction that includes a component in the horizontal direction by a displacement of the soundboard 7, the spherical portion 312 can accordingly rotate, in the tapered surfaces 301*c*, 301*d*, 302*c*, 302*d*, about any axis perpendicular to the Z axis, e.g., about the X axis or the Y axis. Consequently, the connecting member R3 is permitted to be inclined relative to the Z axis about the second pivot point P2, without an excessively large force applied to the connecting member R3.

When the connecting member R3 is inclined by the displacement of the soundboard 7, the tapered surfaces 301*a*, 301*b*, 302*a*, 302*b* can accordingly rotate relative to the spherical portion 92 about any axis perpendicular to the Z axis. Consequently, the connecting member R3 is permitted to be inclined relative to the Z axis about the first pivot point P1, without an excessively large force applied to the connecting member R3.

Thus, the acoustic transducer 50 can maintain an appropriate vibrating function over a long period of time. Further, the plate portions 301, 302 formed of metal enable the force received in the Z-axis direction to be accurately transmitted to the soundboard 7 without a loss. If the spherical portions 312, 92 are also formed of metal, the entirety of each of the first joint portion J1 and the second joint portion J2 is formed of metal, resulting in enhancement of wear resistance.

In the embodiment and the modified examples, any combination other than those illustrated above may be suitably employed. Where the joint portions J1, J2 are common in structure, the manufacturing cost is reduced.

It is only required for the first joint portion J1 to have a structure that enables objects connected to each other by the joint portion J1 to be inclined relative to each other owing to bending, and the motion that causes bending is not limited to a pivotal motion. For instance, the joint portion J1 may be formed of an elastic member such as rubber, and the elastic member may be configured to be elastically deformed to cause bending, like a rubber joint. The joint portion J1 may be formed of soft metal such as soft iron. The first joint portion J1 may be configured such that the first joint portion J1 has a plurality of pivot points that are adjacent to one another in the Z-axis direction and pivotal movements at the respective pivot points provide bending of the joint portion J1 as a whole. The second joint portion J2 may be similarly configured.

The connecting members R, R1, R2, R3 in the embodiment and the modified examples illustrated above have the joint portions J1, J2 at opposite ends thereof. At least one joint portion similar to the joint portions J1, J2 may be provided on the connecting member apart from the joint portions J1, J2.

The soundboard 7 is illustrated as one example of the vibrated body to be vibrated. In addition, the invention is applicable to a structure in which any other member such as a roof or a side board that undergoes a dimensional change functions as the vibrated body to be vibrated. Even in an instance where the vibrated body does not undergo the dimensional change, the invention is useful when the vibrated body is relatively displaced by a dimensional change or deformation of a member that supports the acoustic transducer, in a direction different from or intersecting the vibration direction.

The piano to which the principle of the invention is applicable may be a grand piano or an upright piano. The present invention is applicable to not only the pianos but also various acoustic musical instruments having the acoustic transducer, electronic musical instruments having the acoustic transducer, and speakers. When the invention is applied to the acoustic musical instruments, the electronic musical instruments, and the speakers, the vibrated body that can be forcibly vibrated needs to be provided therein. The present invention is applicable to any structure in which the position at which the vibrated body is connected to the movable unit and the position at which the acoustic transducer is supported relatively shift in a direction different from the vibration direction due to a dimensional change or the like.

What is claimed is:

1. An installation structure for an acoustic transducer configured to operate in accordance with an audio signal for thereby vibrating a vibrated body in a first direction, so as to permit the vibrated body to generate sounds, comprising:

a magnetic-path forming portion fixedly disposed relative to a fixedly supporting portion and forming a magnetic path;

a vibrating unit having an electromagnetic coupling portion electromagnetically coupled to the magnetic-path forming portion, the vibrating unit being configured to vibrate in the first direction when the electromagnetic coupling portion is driven by the magnetic-path forming portion in response to a drive signal based on the audio signal;

a connecting member disposed between (a) a part of the vibrated body or a fixed portion fixed to the vibrated body and (b) the vibrating unit, the connecting member transmitting vibration of the vibrating unit to the vibrated body;

a first joint portion configured to connect a first end portion of the connecting member to the vibrating unit so as to enable the connecting member to be inclined with respect to an axis extending in the first direction; and a second joint portion configured to connect a second end portion of the connecting member to the fixed portion so as to enable the connecting member to be inclined with respect to the axis extending in the first direction.

2. The installation structure for the acoustic transducer according to claim 1, wherein, when the fixed portion is displaced relative to the fixedly supporting portion within a predetermined range in a second direction intersecting the first direction, the second joint portion is displaced relative to the fixedly supporting portion in the second direction owing to bending at the first joint portion and bending at the second joint portion, whereby the connecting member is inclined relative to the axis in the first direction.

3. The installation structure for the acoustic transducer according to claim 1, further comprising a movement restricting member configured to restrict a movement of the vibrating unit relative to the magnetic-path forming portion in a second direction intersecting the first direction.

4. The installation structure for the acoustic transducer according to claim 3, wherein a force applied from the fixed portion to the first joint portion and the second joint portion when at least one of the first joint portion and the second joint portion starts to bend by a displacement, in the second direction, of the fixed portion relative to the fixedly supporting portion is smaller than a force applied from the fixed portion to the vibrating unit when the vibrating unit starts to move by the displacement against a restricting force of the movement restricting member.

5. The installation structure for the acoustic transducer according to claim 3, wherein the movement restricting member is a damper.

6. The installation structure for the acoustic transducer according to claim 1, wherein the connecting member can be inclined in a plurality of directions intersecting the first direction owing to bending at the first joint portion and bending at the second joint portion.

7. The installation structure for the acoustic transducer according to claim 1, wherein the first joint portion is disposed so as to be closer to the fixedly supporting portion in the first direction than the second joint portion is to the fixedly supporting portion in the first direction, and wherein a distance between one end of the vibrating unit in the first direction near to the fixedly supporting portion and the first joint portion is smaller than a distance between the first joint portion and the second joint portion.

8. The installation structure for the acoustic transducer according to claim 1, wherein the vibrating unit further has a rod portion extending in the first direction from the electromagnetic coupling portion toward the vibrated body.

9. The installation structure for the acoustic transducer according to claim 1, wherein the vibrated body is a soundboard of a keyboard musical instrument.

10. The installation structure for the acoustic transducer according to claim 1, wherein the first joint portion is configured to bend such that the vibrating unit and the connecting member are inclined relative to each other, and wherein the second joint portion is configured to bend such that the connecting member and the vibrated body are inclined relative to each other.

* * * * *